United States Patent [19]

Stirniman

[11] 4,229,925

[45] Oct. 28, 1980

[54] SKEIN AND BALL BANDING MACHINE

[76] Inventor: James P. Stirniman, 706 Canal Rd., Rt. 2, Minooka, Ill. 60447

[21] Appl. No.: 912,993

[22] Filed: Jun. 6, 1978

[51] Int. Cl.[3] ..... B65B 13/16

[52] U.S. Cl. ..... 53/399; 53/73; 53/215; 53/587

[58] Field of Search ..... 53/399, 411, 465, 131, 53/211, 215, 587, 73; 93/36 MM; 198/732

[56] References Cited

U.S. PATENT DOCUMENTS

| | | | |
|---|---|---|---|
| 808,955 | 1/1906 | Tocker | 53/215 X |
| 1,096,546 | 5/1914 | Lincoln | 53/211 |
| 1,108,027 | 8/1914 | Thorschmidt | 53/215 |
| 1,987,482 | 1/1935 | Mandell | 53/215 X |
| 2,092,066 | 9/1937 | Haupt | 53/211 |
| 2,368,213 | 1/1945 | Gerlach | 53/211 |
| 2,821,347 | 1/1958 | Stephens | 53/215 X |
| 3,252,560 | 5/1966 | Chamberlein | 198/732 |
| 3,400,642 | 9/1968 | Stemmler | 93/36 MM |
| 3,494,095 | 2/1970 | Valvano | 53/587 X |
| 3,555,764 | 1/1971 | Dowling | 53/73 X |
| 3,650,773 | 3/1972 | Bush et al. | 53/411 X |
| 3,851,443 | 12/1974 | Fine | 53/587 |

FOREIGN PATENT DOCUMENTS

| | | | |
|---|---|---|---|
| 2065102 | 3/1972 | Fed. Rep. of Germany | 53/211 |

*Primary Examiner*—John Sipos

*Attorney, Agent, or Firm*—Hill, Van Santen, Steadman, Chiara & Simpson

[57] ABSTRACT

The machine is disclosed for banding skeins or balls of bunched or wound material such as wool thread. The machine includes a banding apparatus comprised of a plurality of individual banding units connected in a closed loop chain. Each banding unit includes a closed loop endless belt driven by guide rollers. A pocket for receiving the skein or ball of material is formed by a portion of the endless belt. An entrance to the pocket is opened and closed by use of a movable guide roller. The skein or ball to be wrapped is placed into the pocket. A printed band is also placed into the pocket between the skein or ball and an edge wall of the pocket. The pocket is then closed as the belt is rotating. One end of the band has glue thereon so that as the pocket rolls the skein or ball and band, the band is wrapped around so that opposite ends of the band are glued to one another. The banding unit then continues around the closed loop as the glue dries. Finally, the pocket opens and the banded skein or ball drops free onto an outlet conveyor. Preferably the band is printed with indicia such as a dye number or lot number and is then fed in synchronized fashion to one of the banding units shortly after the banding unit receives the skein or ball of material from an input conveyor. The input conveyor, the printer, and the banding apparatus are all synchronized with one another.

35 Claims, 15 Drawing Figures

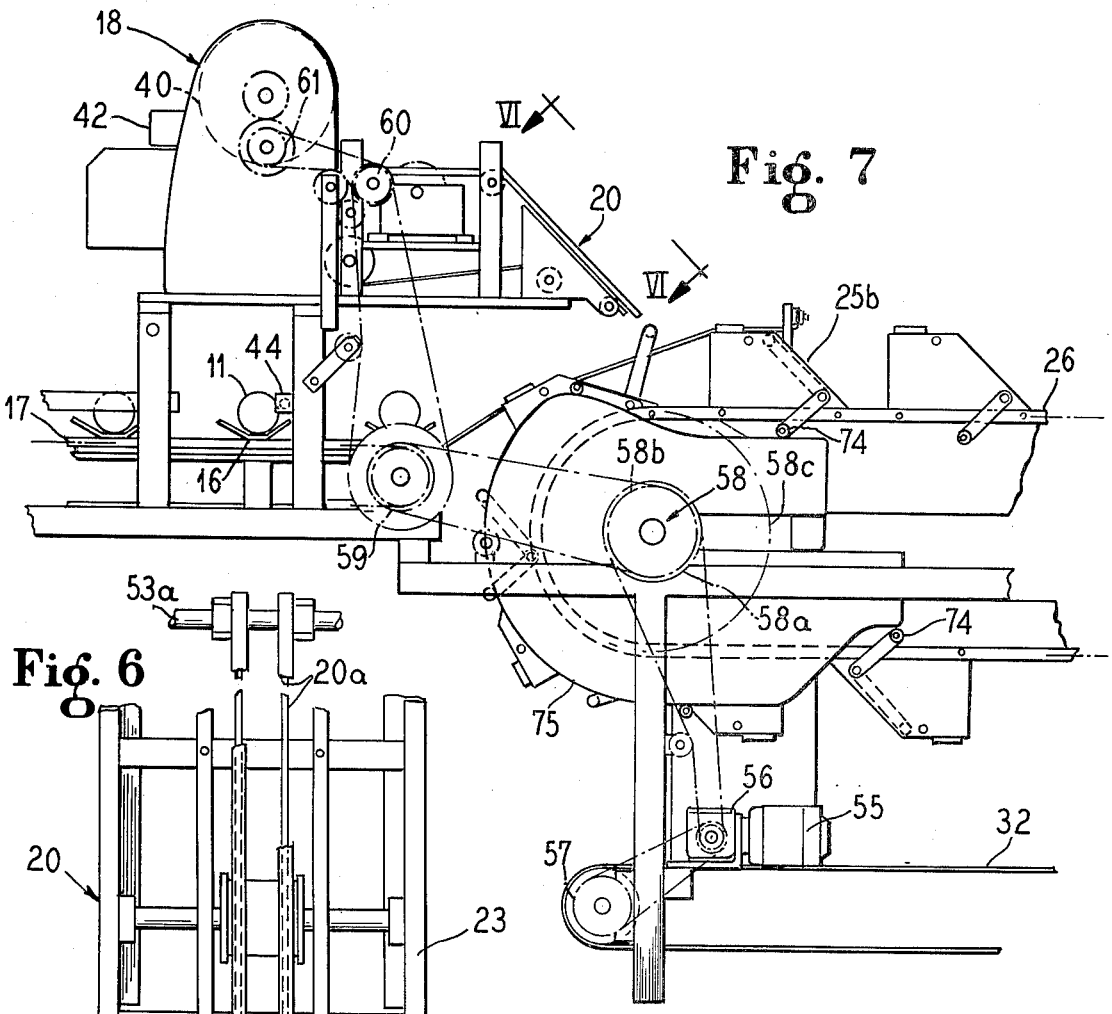
Fig. 7
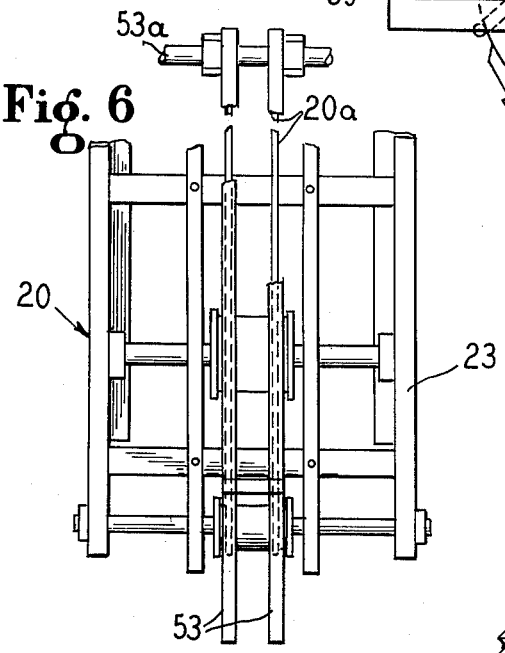
Fig. 6
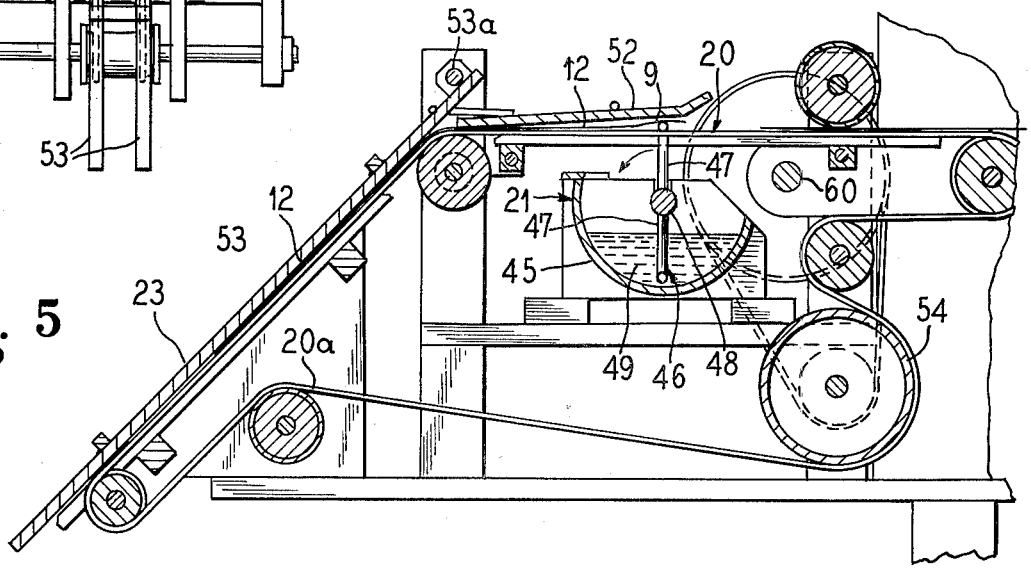
Fig. 5
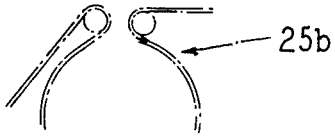

SKEIN AND BALL BANDING MACHINE

BACKGROUND OF THE INVENTION

1. Field of the Invention

This invention relates to banding machines and particularly to banding machines for skeins or balls of bunched or round threadlike material.

2. Description of the Prior Art

Balls or skeins of bunched or wound material are typically bound together by wrapping with a band. The band encircles a portion of the skein or ball so as to slightly compress that portion of the skein or ball. Also, typically the bands will have indicia printed thereon such as shown in FIG. 1 of the drawings wherein such indicia is peculiar to a particular production run such as the color of the dye and the dye lot number in the case of skeins of wool.

It has been known to provide an automatic banding machine for placing bands around such skeins or balls of material. In such known machines, production rates are very slow due at least in part to back and forth translational movements required for machine elements which transport the skein or ball to be wrapped from an input conveyor to a wrapping station. Furthermore, glue at one end of the band must dry prior to removal of the banded skein or ball.

Furthermore, in known banding machines, the labels are first individually printed and then the printed labels are stacked in the banding machine. This operation is time consuming and requires an initial production run for printed bands followed by their separate use in the banding machine.

SUMMARY OF THE INVENTION

It is an object of this invention to provide a banding machine for skeins or balls of bunched thread-like material wherein high production rates can be achieved with a minimum cost.

It is another object of this invention to provide a banding machine wherein the skeins or balls to be handed are continuously moved along in a substantially horizontal direction without the need for movement perpendicular to the principal feed movement for the balls or skeins being wrapped.

It is another object of this invention to provide a banding machine which permits wrappping of skeins or balls while glue on bands of other wrapped skeins or balls is simultaneously drying.

It is a further object of this invention to simultaneously print in synchronized fashion desired indicia on the bands for each production run such that the separate printed bands are fed in synchronized fashion to a banding apparatus together with the skeins or balls to be banded.

It is a further object of this invention to provide a banding machine which accommodates skeins or balls of different diameters and lengths with minimum alteration of machine components.

It is another object of this invention to provide a gluing apparatus in the banding machine which selectively glues a portion of an end of each band prior to being inserted in a banding apparatus.

According to the invention, a banding machine is provided having a banding apparatus with a plurality of separate banding units interconnected in closed loop fashion. Each banding unit has a pocket means formed of a portion of a movable endless belt for receiving an item to be banded. The pocket has an entrance way which is opened and closed by use of a movable guide means. The pocket is opened and an item to be banded is deposited in the pocket by use of an item feed means. Shortly thereafter, just before the pocket closes, a band feed means deposits a band into the pocket between a portion of the pocket and the item therein. As the endless belt moves and the pocket closes, the item is compressed and the band is wrapped around the item. A portion of the band is preferably glued and the glued end comes in contact with the opposite end of the band. After a short period of wrapping, the endless belt stops movement and the glue dries. Thereafter, the pocket is opened and the banded item falls onto an outlet conveyor. As the glue in the banded items is drying, other banding units are receiving items to be banded. A horizontal directional movement of the banding units generally corresponds to a horizontal direction of feed movement for the items to be banded.

A printer may be associated with the banding apparatus such that indicia is selectively printed on individual bands. These bands are then passed through a gluing unit which places a swab of glue at one end of the band and then the bands are fed in synchronization with the items to be banded into a pocket of one of the banding units.

In each banding unit, the endless belt is guided by a plurality of fixed position rollers, at least one pocket forming roller, and a movable position roller. The movable position roller provides the openable and closable entrance way. The at least one pocket forming roller generally defines a diameter of the pocket since a portion of the endless belt is wrapped around the pocket forming roller.

BRIEF DESCRIPTION OF THE DRAWINGS

FIG. 5 is an enlarged fragmentary side view of a gluing unit and band output feed portion of the banding machine of the invention;

FIG. 6 is a fragmentary plan view taken at line VI—VI of FIG. 7 showing in detail the band output feed;

FIG. 7 is a view from the opposite side of the banding machine illustrated in FIG. 3 and showing the synchronized driving system for the invention;

DESCRIPTION OF THE PREFERRED EMBODIMENTS

Figure 1:
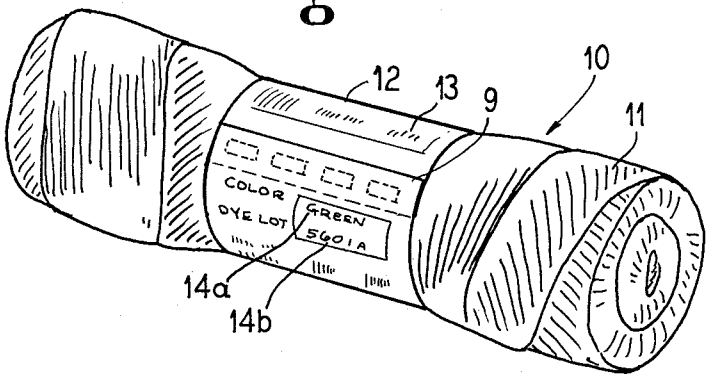
FIG. 1 is a perspective view of a skein or ball with a band having indicia printed thereon wrapped around the skein so as to compress central portions of the skein.

As shown in FIG. 1, a bound or bunched skein 10 is shown. A skein 11 of yarn, wool or other fibrous thread-like material is compressed at central portions by a paper band or strip 12 which is glued at its ends in an endless loop and serves as a label and as a binder for encircling and compressing the skein 11. Preprinted indicia 13 such as promotional or other decorative indicia are provided on the label. Also provided are selectively printed indicia 14*a, b* such as color and dye lot number identifications for a particular production run. A glued end 9 of the band maintains the band in a closed loop.

Figure 2B:
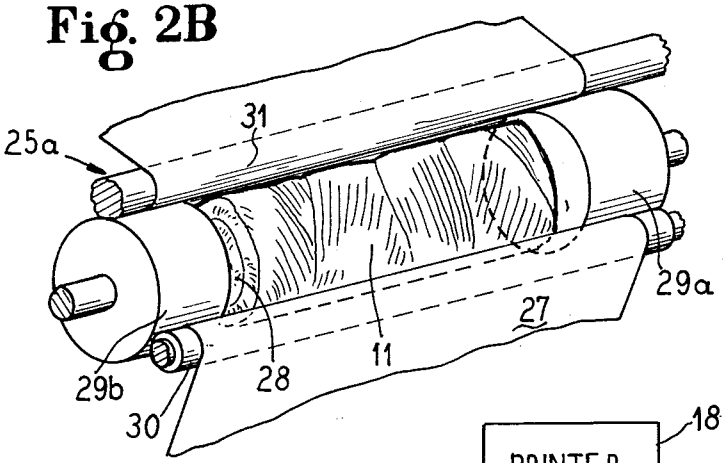
FIG. 2B is a perspective view of a pocket formed in each of the banding units of the banding apparatus shown in FIG. 2A.
Figure 2A:
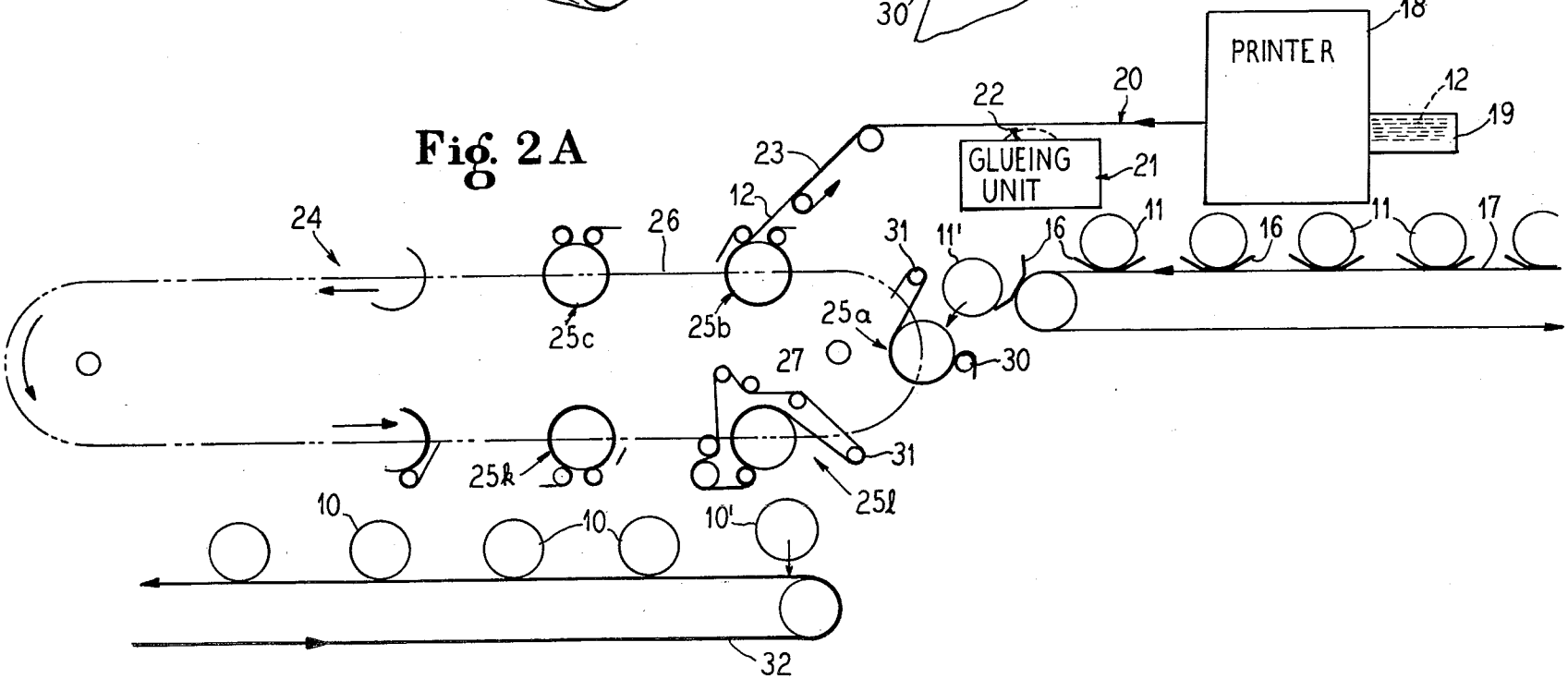
FIG. 2A is a schematic representation of the banding machine of this invention.

Now referring to FIG. 2A, a banding machine of this invention is schematically illustrated for producing the finished product shown in FIG. 1. Generally, the skein 11 to be banded is conveyed into the machine by an input conveyor 17 having a plurality of hoppers or troughs 16 on a surface thereof. A ditto machine or other style of conventional copying or printer machine 18 is provided which is capable of selectively printing indicia such as 14*a, b* on the bands 12. A label or band storage unit 19 is provided having a stack of bands 12 therein. This storage unit 19 connects with the printing machine 18. A band output conveyor 20 connects with the printing machine 18 and also passes over a gluing unit 21 for gluing the end 9 of each band. In the gluing unit 21, tongues or fingers 22 touch the end 9 of the band. The glued bands are then conveyed by a band feed portion 23 of the conveyor 20 to a banding apparatus 24.

The banding apparatus 24 is comprised of a plurality of individual banding units 25*a* through 251. These banding units are connected in a continuous closed loop fashion by a synchronized drive linkage 26 such as a belt, sprocket chain or the like.

The banding unit 25*a* shown in FIG. 2A has a pocket 28 more clearly shown in FIG. 2B which is open and has a skein 11' deposited therein. At 25*b* in FIG. 2A a banding unit is illustrated in which the pocket is beginning to close and which is receiving a glued band 12. At 25*c* a banding unit is shown with its pocket closed and in which the band has been rolled around the skein and the glue is beginning to dry. Banding units 25*c* through 25*k* represent banding units in which the glue is drying. Finally, at banding unit 251, the pocket opens and a banded skein 10' drops down onto an output conveyor 32.

As shown in the schematic perspective view of FIG. 2B, each banding unit has a pocket 28 formed of a portion of a wide endless belt 27. Pocket forming rollers 29*a, b* are provided which form sides of the pocket and also determine a diameter of the pocket since a portion of the endless belt 27 is wrapped therearound with the belt 27 remaining in contact with rollers 29*a,b* during wrapping. By changing the size of the rollers and their spacing, the size of the pocket can be conveniently changed. A fixed pocket entrance roller 30 is provided in combination with a swingable or movable pocket entrance roller 31.

Figures 3, 4, 12:
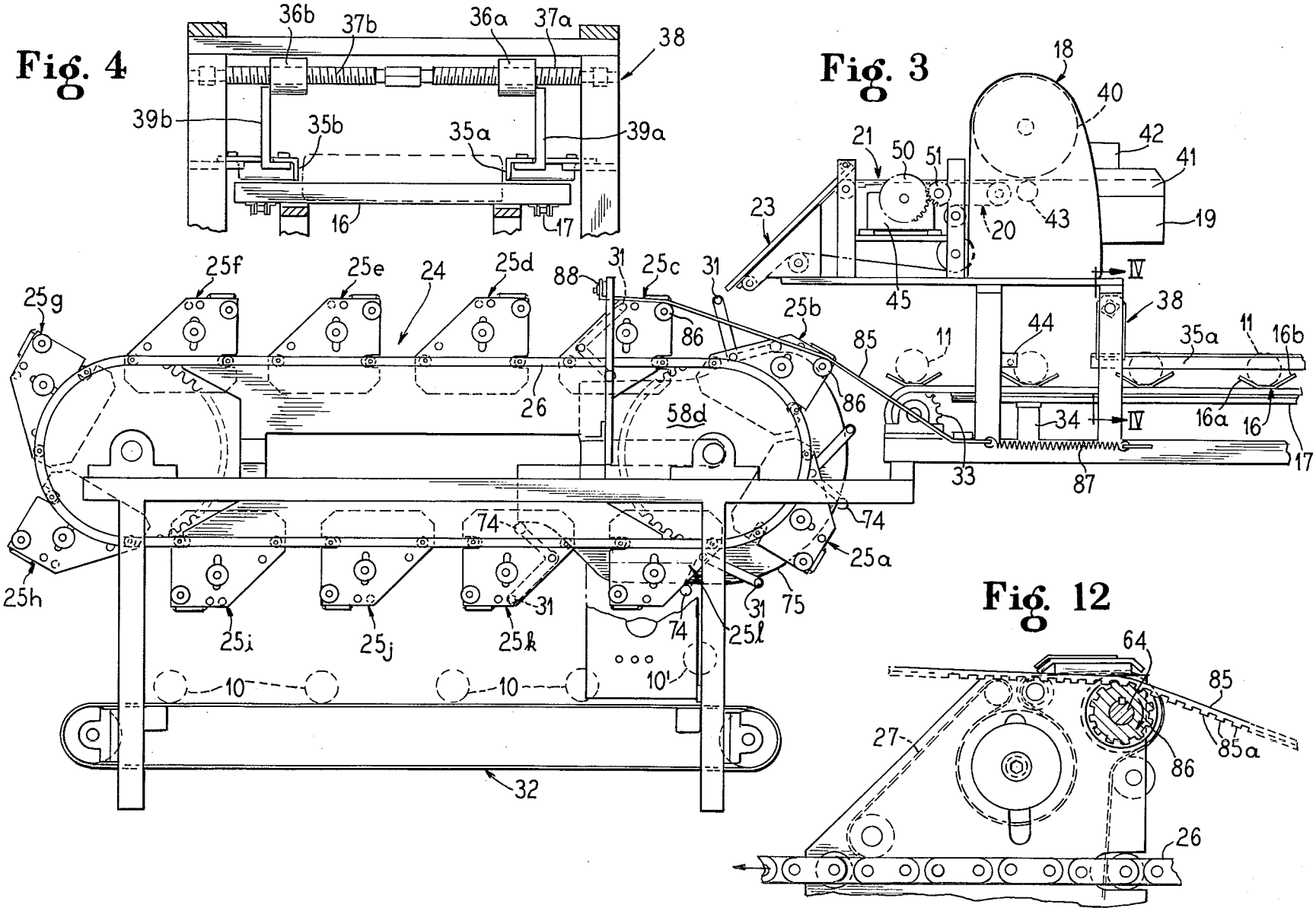
FIG. 3 is a side view of the banding machine of the invention.
FIG. 4 is a cross-sectional view taken along IV—IV of FIG. 3 and showing an input conveyor system of the banding machine of the invention.
FIG. 12 is a side view illustrating a drive system for one of the banding units shown in FIG. 3.

Referring now to FIG. 3, the banding machine shown in FIG. 2A is illustrated in detail with the reference numerals in the schematic illustration of FIG. 2A also being indicated in FIG. 3 to show the corresponding elements in detail.

The various portions of the banding unit shown in FIG. 3 will now be described, with initial attention directed to FIG. 4 in combination with FIG. 3. As illustrated in these figures, an input conveyor 17 is provided which includes a plurality of troughs 16 driven by a sprocket chain. Each of the troughs 16 contains a skein 11. To insure that the skein 11 is centered within the trough 16, the trough has slanted portions 16*a* and 16*b* which cause the skein to self-center in a longitudinal direction of the conveyor 17. The conveyor 17 includes a sprocket drive wheel 33 and a support 34 for the drive chain. To insure centering of the skeins 11 on the conveyor 17 in a direction perpendicular to movement, adjustable centering guide walls 35*a, b* are provided as shown in FIG. 4 which converge in the direction towards the banding apparatus 24. These centering guides 35*a, b* are adjustable via adjusting nuts 36*a, b* arranged on adjusting screws 37*a, b*. The nuts and screws comprise a centering guide adjustment assembly 38 generally located as shown in FIG. 3. A connecting member 39*a, b* pivotably connects the centering guides 35*a, b* to the adjusting nuts 36*a, b*. By changing the position of the nuts on the screws 37*a, b*, one end of each of the centering guides is moved while the opposite end not shown in the drawing is held fixed. Consequently, the degree of convergence can be changed to accommodate various skein lengths.

As shown in FIG. 3, the printer 18 is provided over the end of the input conveyor 17. The printer 18 is of a conventional type and may constitute a ditto or mimeograph machine or other form of duplicating machine. In the preferred form of this invention, a ditto machine was utilized having a rotating drum 40. A band storage unit 19 with a band feed portion 41 feeds band 12 to the drum 40. A band feed control box 42 is provided which also connects with a sensor 44. The sensor 44 may be a photoelectric sensor which detects the presence of a skein 11 in the trough 16 at the location of the sensor 44. If no skein or ball is present, then the band feed control box 42 prevents further feeding of bands to the drum 40. A roller 43 is provided in known fashion beneath the drum 40 for printing of the bands.

At the outlet side of the printer 18, a band output conveyor 20 is provided preferably formed of a series of endless driving bands. A top portion of the conveyor bands 20 pass over a gluing unit 21 most clearly shown in FIG. 5.

The gluing unit 21 includes a glue storage pot 45 and a rotating glue applicator 46 on a shaft 48 above the storage pot 45. A plurality of applicator fingers 47 extend radially in spoke-like fashion from the shaft 48. These fingers 47 rotate down into the glue in the glue pot 45 and then swipe across an end 9 of the band or label 12 to be glued. The fingers extend between the driving bands of the conveyor 20. A driving gear shown in FIG. 3 is attached to the shaft 48 and is in turn driven by a pinion gear 51.

As shown most clearly in FIG. 6, the output conveyor 20 has as mentioned above, a plurality of spaced flexible drive bands 20*a*. As the fingers pass up through these spaced bands 20*a*, they come in contact with the end 9 of the strip 12. A gluing pressure strip 52 as shown in FIG. 5 creates a downward pressure if the applicator fingers 47 swipe across the end 9 of the band 12.

Figure 14:
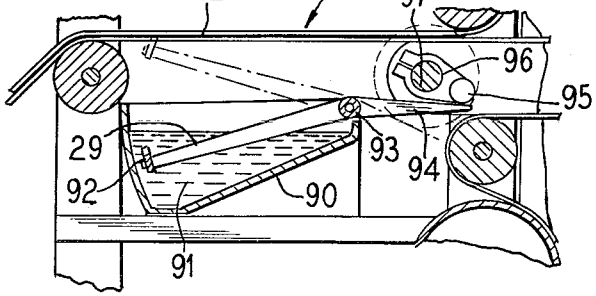
FIG. 14 is a side sectional view of an alternate gluing device.

In an alternate embodiment shown in FIG. 14, the gluing unit 21 is formed of a glue pot 90 having glue 91 therein. A dipping arm 29 having a dabbing plate 92 at an end thereof is provided in pivoting fashion about a pivot point 93. An extension 94 of the arm 29 is deflected by a striker wheel 95 on the end of a striker arm 96. The striker arm 96 has its other end connected to a shaft 97. As the shaft 97 rotates the dabbing plate moves upward against the band 12 to deposit glue thereon.

A feed portion 23 of the conveyor 20 is shown in FIG. 5 and also in plan view in FIG. 6. This feed portion includes pivoting upper pressure strips 53 which lay in resting contact on the printed band 12 being transferred. These pressure strips 53 insure good frictional contact between printed bands 12 being transferred and the drive bands 20*a*. By having one end of each of the strips 53 pivoted permits grabbing of printed bands 12 in the banding unit 25*b*. When this grabbing occurs, the printed band breaks loose from frictional engagement with the drive bands 20*a*. The pivoting at 53*a* of the strips 53 facilitates this frictional disengagement. As shown in FIG. 5, the drive bands 20*a* are guided by a plurality of rollers and are driven with a driven roller 54.

If desired, in place of the strips 52, 53 an upper driven drive band assembly may be provided with the band 12 driven between the drive bands 20*a* and the upper band assembly.

A description for the synchronized drive of the entire machine is shown generally at FIG. 7. A motor 55 connects with a gear reduction and angle drive unit 56. A driven roller 57 connects with the angle drive unit 56 so as to drive the output conveyor 32. A centralized driving assembly 58 is provided having four sprocket wheels 58*a, b, c, d.* Wheel 58*a* serves as an input. Wheel 58*b* serves as an output for driving the input conveyor 17 and printer 18. Wheels 58*c* and 58*d* drive sprockets for drive linkage 26 of the banding apparatus 24 discussed in detail hereafter. A drive wheel 59 on the input conveyor 17 connects with the drive assembly 58. This drive wheel connects to drive the printer 18, the gluing unit 21, and the band output conveyor 20. A glue unit and output conveyor drive assembly 60 is provided which connects with the drive wheel assembly 59 and serves to drive the glue unit. The printer drive wheel 61 is connected by drive chain to the drive assembly 60.

The entire drive system described above provides a synchronized driving of the input conveyor 17, printer 18, band feed unit 41, band output conveyor 20, and banding apparatus 24. This synchronized drive is important to insure that the bands 12 and the skeins 11 arrive at the banding apparatus 24 at appropriate moments when particular individual banding units 25*a* through 251 are in position for loading of the skeins 11 and bands 12.

Figures 8, 10:
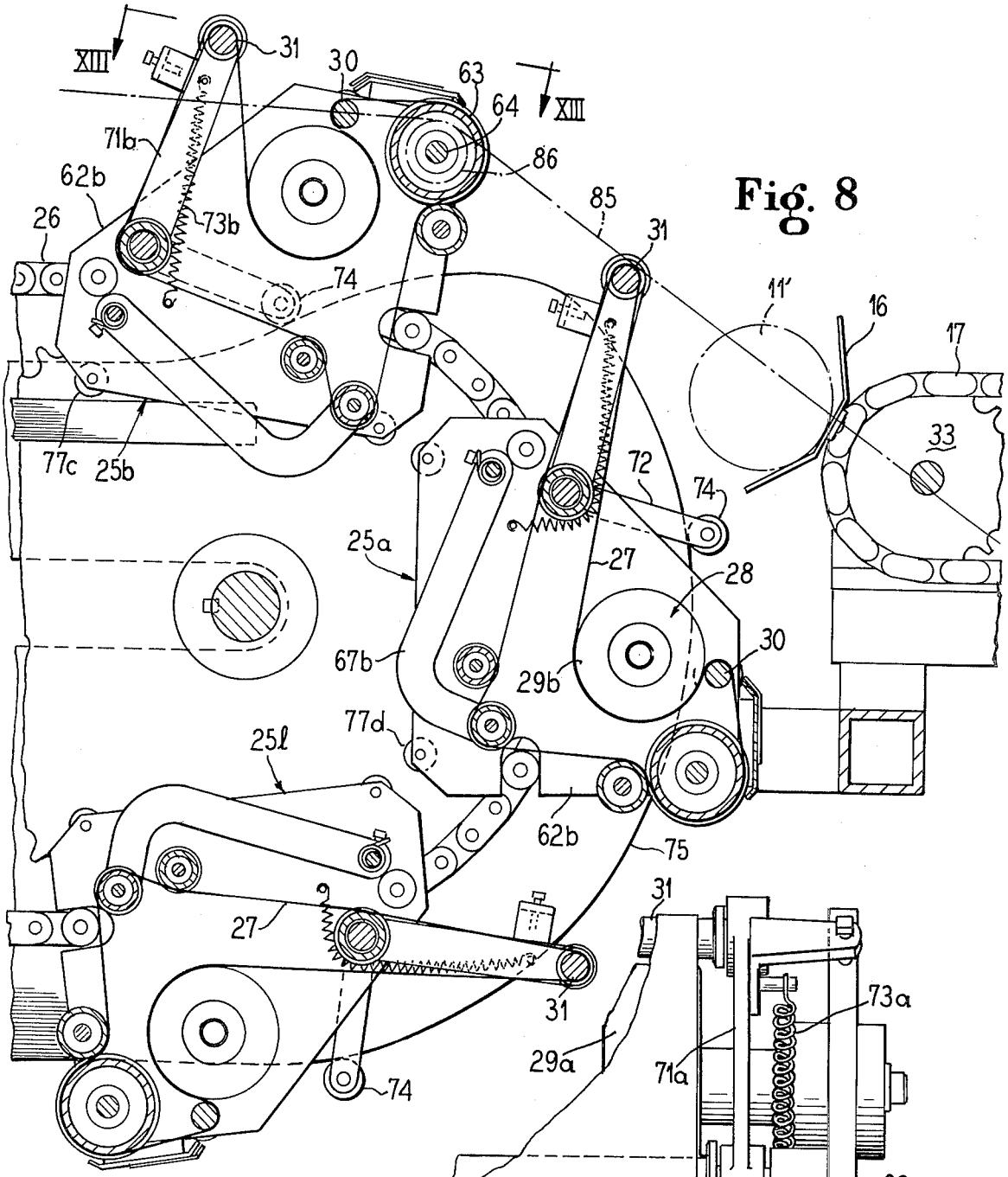
FIG. 8 is an expanded side view of individual banding units in a banding apparatus of the banding machine of this invention.
FIG. 10 is a fragmentary view of a drive mechanism taken along line X—X of FIG. 9 for the banding unit shown there.
Figure 9:
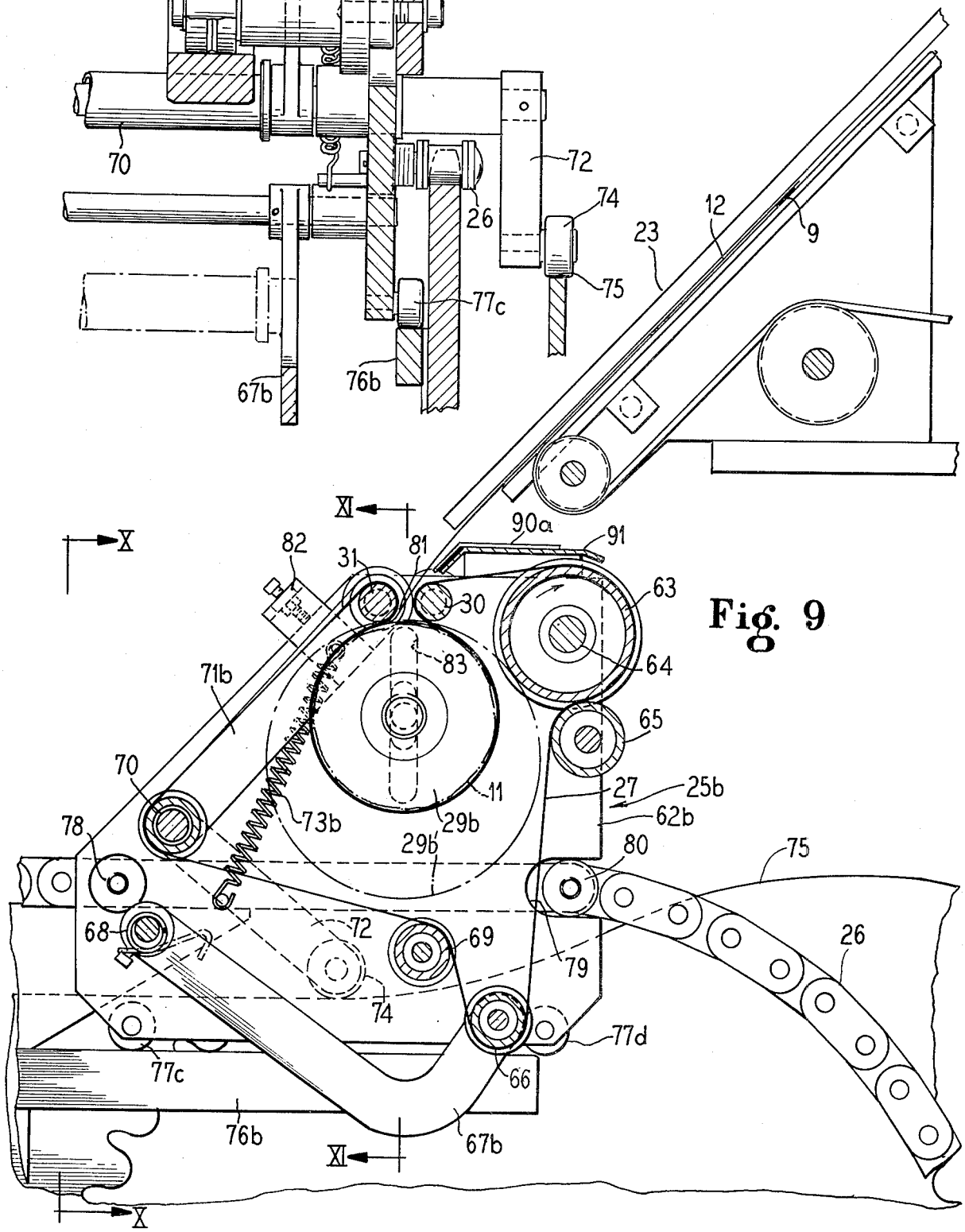
FIG. 9 is an expanded side view of one of the banding units of the invention as it is receiving a band from a band feed conveyor.

The banding apparatus 24 will now be described in detail. Referring to FIGS. 8 and 9, a construction of one of the banding units 25*a* will be described although the construction of all banding units is substantially identical. An endless belt 27 formed as a closed loop is provided between spaced side frames 62*a, b.* A plurality of rollers are supported between the side frames which carry the belt 27 and guide it along the desired path. Specifically, the endless belt encounters the following rollers around the loop. As seen in FIG. 9, first, a swingable pocket entrance roller 31 is provided. Thereafter, the belt passes over pocket forming rollers 29*a, b* which are aligned on a common axis. Thereafter the belt passes over a fixed pocket entrance roller 30 adjacent the swingable pocket entrance roller 31. These two rollers form the openable and closable entranceway to the pocket 28 generally illustrated in the perspective view in FIG. 2B. The belt 27 then winds around a drive roller 63 with frictional engagement caused by a first guide roller 65 directly adjacent the drive roller 63. The belt is then formed around a movable biased dancer roller 66 which is mounted on arms 67*a, b* and including a torsional spring 68 (See also FIG. 10). The belt than passes to a second guide roller 69, a third guide roller 70, and then back to the point of beginning at the swingable removable pocket entrance roller 31.

The movable or swingable roller 31 is mounted on supporting arms 71*a, b* biased by springs 73*a, b.* A lever arm 72 at substantially right angles to the supporting arms 71*a, b* has a cam wheel 74 which rides along a cam surface 75. This cam surface 75 is discussed below and generally has a shape shown most clearly in FIG. 8.

Horizontal tracks 76*a, b* are provided on which binding units such as 25*c* and 25*d* at a top of the banding apparatus ride along by virtue of wheels 77*a, b, c, d* on side frames 62*a, b.* These tracks and associated wheels assure accurate positioning of the rollers 31 and 30 during feed in of the band 12 as illustrated in FIG. 9.

The individual band units connect with the drive linkage 26 by virtue of fixed connection points 78 and a slot 79 within which a projection 80 on linkage 26 is arranged. This combination of a projection 80 and a slot 79 permits free movement of this portion of the linkage within the slot and thus permits a lengthening of securing points between each banding unit and the drive linkage.

As shown in FIG. 9, the leading edge of the printed band 12 shown at 81 is gripped between a portion of the belt 27 adjacent the movable roller 31 and the skein 11. An adjusting unit 82 is provided to set the gap between the movable roller 31 and fixed roller 30. As shown in dotted lines is a larger pocket roller 29*b'* for use with skeins of larger diameters. The slot 83 is provided for adjustable mounting of various size pocket forming rollers.

Figure 11:
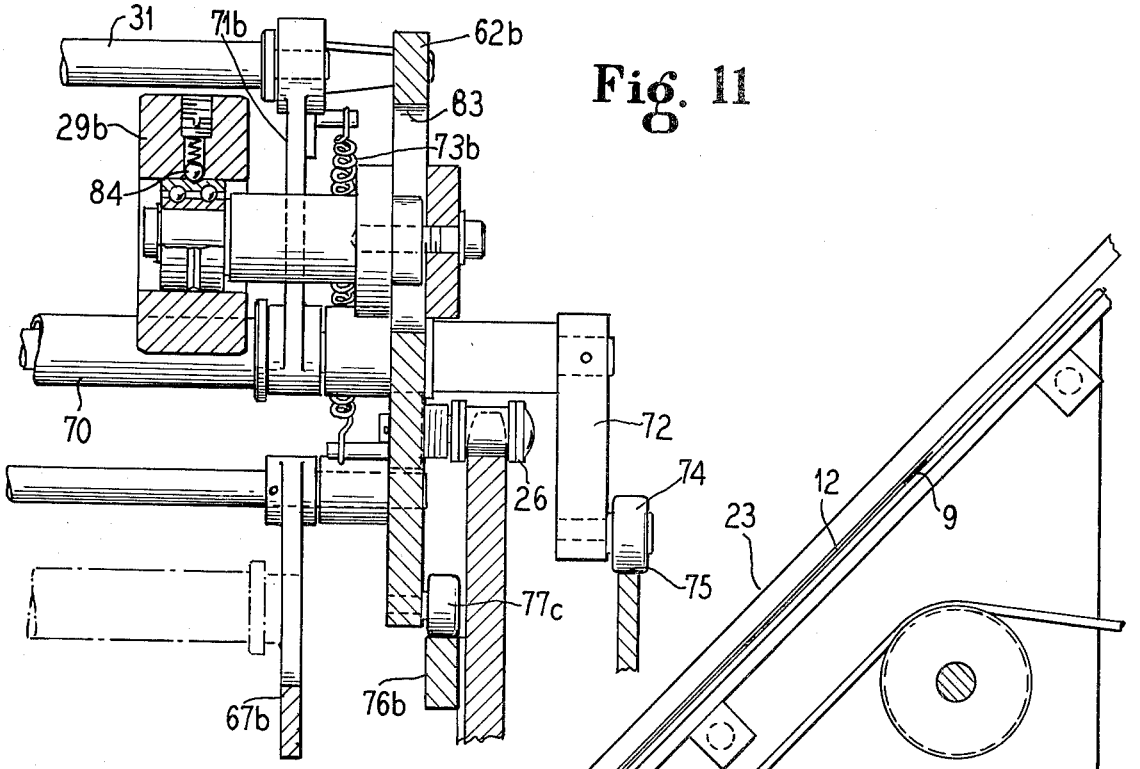
FIG. 11 is a fragmentary cross-sectional view taken along line XI—XI of FIG. 9.

As shown in FIG. 11 a quick release detent assembly 84 is provided for simplified replacement of various size pocket forming rollers 28*a, b.* Also, the spacing distance between rollers 29*a, b* can be widened or shortened to accommodate the length of the skein.

Referring now to FIGS. 3 and 12, the drive system for the endless belt 27 of each banding unit will be described. A flexible timing belt 85 is provided having a plurality of teeth 85*a* which engage a driving wheel 86 on a shaft 64 of each banding unit 25*a* through 1. The shaft 64 connects with the drive roller 63 to drive the belt 27. A spring 87 connecting to one end of the drvie belt 85 permits the belt to deflect when in contact with the driving wheel 86 as the appropriate driving unit passes around the closed loop of the banding apparatus. The other end of the drive band 85 is attached to a fixed mounting point 88.

Figure 13:
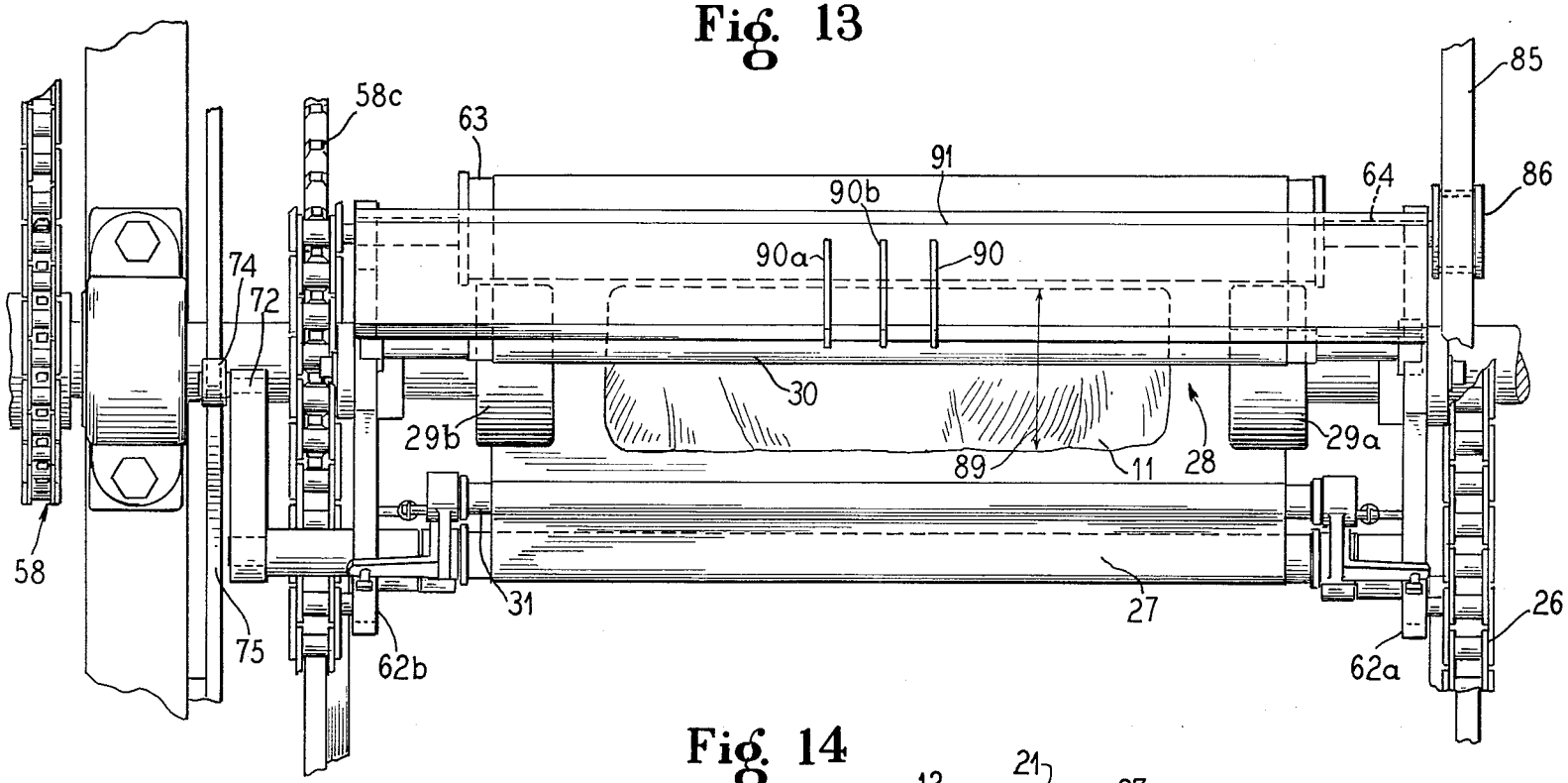
FIG. 13 is a plan view of one of the pockets of a banding unit taken along line XIII—XIII of FIG. 8.

Referring now to FIG. 13, the pocket 28 of each banding unit formed by a portion of the endless belt 27 is shown. It should be noted that the pocket forming rollers 29*a, b* have a diameter smaller than fluffed end diameter 89 of the banded skein 10 after release from the pocket. Consequently, the skein will be compressed and portions of the skein not surrounded by the band will fluff out as shown in FIG. 1.

Wire ribs 90*a, b, c* are also provided at the top of each banding unit for spacing the glued end of the band away from a cross connection plate 91 at the entranceway to the pocket.

Overall operation of the banding machine with particular emphasis on the banding apparatus as illustrated in FIG. 3 will now be described. Skeins 11 to be wrapped enter along the input conveyor 17. In synchronization with this conveyor 17, bands are conveyed to the printer unit 18 and individually printed. These printed bands then pass over the gluing unit where an end 9 of each band is glued. The glued bands then pass down the feed portion 23 in synchronized fashion. A banding unit 25*a* has its pocket opened since the movable guide roller is moved to an open position as a result of the cam surface 75 in contact with the cam roller 74. As the banding unit 25*a* passes adjacent the input conveyor 17, a skein 11 to be banded drops into the pocket. At about the same time, a banding unit 25*b* running ahead of the banding unit 25*a* is either about to receive or is receiving a printed band. By feeding the skein into a unit 25*a* and receiving a band into unit 25*b*, a larger number of banding units may be provided than would be the case if a given banding unit received both the skein and a band before any other banding unit received either a skein or band. After unit 25*b* has received its band, then unit 25*a* receives a band.

It is noted that unit 25*b* comes in contact with the driving band 85 so that the endless belt begins moving just prior to receiving the printed band. This movement of the endless belt continues as long as the driving wheel 86 is in contact with the flexible drive band 85. This is arranged so that after the banding unit receives the skein and printed band, the pocket rotates the band and skein so as to roll the band around the skein such as shown at the unit 25*c*. Thereafter, as represented by units 25*d, e, f, g, h, i, j,* and *k*, the pocket is closed and the endless belt is not moving. During this time the end 9 of the glued band dries. Finally, at position 25*k*, the pocket is again opened as the cam roller engages the cam surface 75. At 251 the pocket is fully opened and the banded skein 10' drops free onto the output conveyor 32.

Whenever in the claims the term skein is used, it is to be understood that balls may also be employed.

Although various minor modifications may be suggested by those versed in the art, it should be understood that I wish to embody within the scope of the patent warranted hereon, all such embodiments as reasonably and properly come within the scope of my contribution to the art.

I claim:

1. A banding machine system for wrapping a band around a compressible skein of material to be banded, comprising:

(a) a belt extending in a predetermined direction formed in a closed loop;

(b) first and second pocket forming guide rollers axially spaced apart from each other and transversally to said predetermined direction, portions of the belt being formed around peripheral portions of the first and second guide rollers;

(c) a partially cylindrical pocket means for receiving the skein to be banded and formed of end walls and a curved main wall, the end walls comprising end surfaces of the first and second guide rollers and the curved main wall comprising portions of the belt formed around the first and second guide rollers, the end walls being spaced sufficiently to permit placement of the skein entirely therebetween and a diameter of the end walls being less than a maximum diameter of the skein such that the skein will be compressed in the pocket means to the diameter of the end walls;

(d) skein feed means for placing the skein in the pocket means;

(e) band feed means for placing the band between the skein and the belt; and (f) drive means for moving the belt around the pocket forming guide rollers and to thereby wrap the band around the skein with the belt remaining in substantially complete circumferential contact with the first and second guide rollers throughout the wrapping operation.

2. A banding machine for wrapping a printed band around a compressible skein of material comprising:

(a) a plurality of separate banding units each having pocket means comprised of a moving belt extending in a predetermined direction supported by first and second pocket forming guide rollers axially spaced from each other and transversally to said predetermined direction for receiving the skein and printed band between the guide rollers and for compressing the skein to the diameter of said guide rollers wrapping the band around the compressed skein to said diameter;

(b) connecting means connecting adjacent banding units with one another so as to form an oval-shaped loop having upper and lower substantially horizontal linear portions connected by first and second curved portions;

(c) printing means for printing indicia on the band and glue means for gluing a portion of each band;

(d) skein feed means for transporting the skeins into the pocket means of said banding units;

(e) band feed means for transporting the printed bands from the printing means to a location directly above the upper linear portion of the loop of banding units and then between the skein and the belt;

(f) means for releasing the skeins from the lower linear portion of the loop; and (g) drive means providing driving movement for said belt of said banding units to wrap the bands around the skeins with the moving belt of the pocket means remaining in substantially complete circumferential contact with the first and second guide rollers throughout the wrapping operation.

3. A banding machine for wrapping bands about a compressible item to be banded, comprising:

(a) a banding apparatus having a plurality of separate banding units with connecting links between adjacent banding units and loop guide means for positioning and guiding the banding units in a closed oval loop formed of upper and lower linear portions and first and second curved portions at opposite ends of the linear portions;

(b) each banding unit having a pocket means defined by a movable belt extending in a predetermined direction and supported by first and second pocket forming guide rollers axially spaced apart from each other and transversally to said predetermined direction, said pocket means receiving an item to be banded, receiving a band, compressing the item to a diameter of the guide rollers, and wrapping the band around the item to said diameter;

(c) said movable belt being formed in a closed loop and supported by guide means;

(d) item feed means for placing an item to be banded in the at least one banding unit and item release means directly below the lower linear portion;

(e) band feed means for placing a band in at least one banding unit when said one banding unit is in the upper linear portion of the loop;

(f) driving and synchronizing means for driving and synchronizing movement of the banding apparatus and to drive said belt to thereby wrap the bands around the skeins with the movable belt remaining in substantially complete circumferential contact with the first and second guide rollers throughout the wrapping operation.

4. The machine of claim 3 wherein the drive and synchronizing means drives the banding units around the loop by driving connection to the connecting links.

5. The machine of claim 3 wherein said guide means comprises a plurality of fixed position guide rollers and a movable guide roller, said movable guide roller in cooperation with an adjacent fixed position guide roller forming a controllable entranceway into the pocket means.

6. The machine of claim 3 wherein said pocket means is formed by said portion of the movable belt being wound partially around the first and second pocket forming rollers.

7. The machine of claim 6 wherein means are provided for removable mounting of the first and second pocket forming rollers to facilitate changing to different diameter rollers for changing dimensions of the pocket means.

8. The machine of claim 3 wherein a flexible timing drive belt is provided adjacent the loop of banding units at the first curved portion and a drive wheel is connected to the guide means of each banding unit, the loop of banding units and timing drive belt being positioned such that the drive wheel of each banding unit selectively engages the drive belt over only a portion of travel of each banding unit around the loop, the drive belt flexing and being deflected when engaged.

9. The machine of claim 3 wherein said pocket means comprises a movable guide roller means for opening and closing access to the pocket means, said movable guide roller means being deflected by a cam situated at a portion of the closed loop adjacent the item feed means and band feed means.

10. The machine of claim 8 wherein the timing drive belt has a bias spring at one end.

11. The machine of claim 3 wherein said pocket means comprises a plurality of fixed position rollers, a spring biased dancer roller means for applying a biased tension to the belt, and a movable roller mounted on a movable arm.

12. The machine of claim 3 wherein the connecting links connect to each banding unit by a pivoting connecting means and a slotted connected means comprising a protrusion on the connecting links receivable in a slot of the banding unit.

13. The machine of claim 3 wherein each banding unit has parallel side walls connected together by said guide means.

14. The machine of claim 3 wherein an item output conveyor means is positioned below the lower linear portion and is positioned to receive items dropped from the banding units when the banding units are in the lower linear portion.

15. The machine of claim 3 wherein a gluing means having glue applying fingers is provided for depositing the glue at one end of each band, said fingers being positioned at the band feed means.

16. The machine of claim 3 wherein a printer means is provided for printing indicia on the bands, said printer means feeding the bands to the band feed means.

17. The machine of claim 15 wherein said gluing means comprises a container means for holding glue and rotating finger means for dipping into the glue in the container means and then swiping the glue across the end of each band.

18. The machine of claim 17 wherein said rotating finger means comprises a hub with spoke-like protrusions therefrom.

19. The machine of claim 3 wherein said band feed means comprises a plurality of driving bands in frictional engagement with the bands to be wrapped, pivoting strip means resting on the driving bands for enhancing said frictional engagement but permitting release of the bands when the bands become engaged by one of the banding units, and glue applying means comprising rotating fingers which are aligned between at least two adjacent driving bands.

20. The machine of claim 3 wherein a printing means is provided for printing and feeding bands to the band feed means, and a sensor means is provided which is positioned adjacent said item feed means for sensing whether an item is present at a given location on the item feed means, and, if no item is present, initiating a stoppage of band feed to the banding apparatus.

21. The banding machine of claim 3 wherein said item feed means comprises a conveyor having a plurality of item retaining hopper means thereon for positioning and centering items to be banded at predetermined intervals along the conveyor, centering guide means also being provided for centering the items with respect to a longitudinal guide line along the conveyor.

22. The machine of claim 21 wherein said centering guide means comprises a pair of strips converging in a direction toward the banding apparatus.

23. The machine of claim 3 wherein the item feed means has a lateral feed point positioned at the first curved portion of the loop to feed the items to banding units in the first curved portion.

24. The machine of claim 15 wherein said gluing means comprises deflectable arm means with glue dabbing means on an end thereof.

25. A banding machine for wrapping printed bands around a compressible skein of bunched or wrapped material, comprising:

(a) a banding apparatus having a plurality of separate banding units linked together in successive fashion in a closed loop by a drive chain between each banding unit, said closed loop having at least one substantial linear portion;

(b) each banding unit having a movable endless belt extending in a predetermined direction and supported by a plurality of fixed position guide rollers, a pair of spaced apart pocket forming guide rollers of diameter less than a maximum diameter of the skein and axially spaced apart from each other and transversally to said predetermined direction so as to compress the skein to the diameter of the guide rollers, and by a movable guide roller, a skein receiving pocket being formed between the guide rollers and by a portion of the endless belt wrapped around a portion of the pair of pocket forming guide rollers, a drive wheel being connected to one of the fixed position rollers;

(c) each banding unit including parallel spaced apart side walls having the fixed position and pocket forming guide rollers therebetween;

26. A method of wrapping a band around a compressible item of material, comprising the steps of:

(a) providing an item receiving pocket formed by a portion of a belt extending in a predetermined direction and supported by a pair of pocket forming rollers axially spaced apart from each other and transversally to said predetermined direction and which partially compress the item to a diameter of the pocket forming rollers;

(b) providing means for opening and closing the pocket;

(c) opening the pocket, feeding the item into the pocket between the pocket forming rollers, and compressing the item to the pocket forming roller diameter;

(d) gluing a portion of a band and feeding the band between the item and a portion of the pocket;

(e) moving the belt and closing the pocket to wrap the band around the item in the compressed state with the belt remaining in substantially complete circumferential contact with the first and second guide rollers throughout the wrapping operation to create a banded item; and (f) opening the pocket to release the banded item which remains partially compressed by the band.

27. The method of claim 26 including the further steps of printing indicia on the band prior to feeding the band to the receiving pocket.

28. The method of claim 26 including the step of moving the pocket and feeding the band to the pocket in substantially the same direction with the pocket moving substantially linearly.

29. A device for banding compressible skeins or balls of yarn comprising:

a banding station; means forming a pocket for receipt and compression of the skein to be banded at said banding station, said means including a belt extending in a predetermined direction and supported by a pair of pocket forming rollers between which the skein is placed and said rollers having a diameter equivalent to a diameter of the skein after a desired compression for wrapping; said rollers are axially spaced apart from each other and transversally to said predetermined direction, skein feed means for in feeding the skein to be banded to said pocket means; band feed means for in feeding a band to said pocket means; rotating means for causing rotation of said skein to be banded at said station to wrap said band around said skein to be banded with the skein compressed to a diameter of the pocket forming roller and with the belt remaining in substantially complete circumferential contact with the pocket forming roller throughout the wrapping operation; and discharge means for discharging said banded skein from said station.

30. The device of claim 29 including means for moving said station along a closed path having at least one substantially linear portion directly below said band feed means such that the band is fed to the pocket when the pocket is travelling along the linear path.

31. The device of claim 29 wherein a plurality of said stations are provided which are linked by a flexible drive chain so as to form an oval-shaped loop having parallel and horizontal linear portions and half-circle curved end portions, the skein feed means being positioned at one end of the linear portions above the loop, the band feed means being positioned directly above one of the linear portions, and a skein discharge receiving member being positioned directly below the other linear portion.

32. The device of claim 31 wherein a discharge position on said endless conveyor is provided, said discharge position spaced from said band feed means a distance sufficient to allow a drying of a glue applied to the band at the band feed means prior to arrival at the discharge station.

33. The device of claim 29 wherein said band feed means comprises a plurality of spaced drive belts lying in the same plane and gluing unit is positioned such that glue applying fingers of the gluing unit sweep through the space between the drive belts.

34. The device of claim 29 including a printing means for printing die lot number on the bands as the bands are being fed to the pocket.

35. The device of claim 29 including means for moving the pocket along a closed path having at least one substantially linear portion to provide longer glue drying time during banding.

* * * * *

UNITED STATES PATENT AND TRADEMARK OFFICE

CERTIFICATE OF CORRECTION

PATENT NO. : 4,229,925

DATED : October 28, 1980

INVENTOR(S) : James P. Stirniman

It is certified that error appears in the above—identified patent and that said Letters Patent is hereby corrected as shown below:

Col. 1, line 42, "handed" should be --banded--.

Col. 6, line 57, "drive" is misspelled.

Col. 8, line 22, --a-- should be inserted after "having".

Col. 8, line 29, after "rollers", --and-- should be inserted.

Col. 8, line 66, "transversely" was misspelled.

Col. 9, line 10, --and-- should be inserted after "loop;".

Col. 11, line 7, after paragraph c add:

d) a drive band positioned to engage the drive wheel on each banding unit as the banding unit passes adjacent the drive band and to thereby wrap the band around the skein with the banding unit endless belt remaining in substantially complete circumferential contact with the pocket forming guide rollers throughout the wrapping operation;

e) a spring biased lever means connected to the movable guide roller, said lever means having a portion

UNITED STATES PATENT AND TRADEMARK OFFICE

CERTIFICATE OF CORRECTION

PATENT NO. : 4,229,925

DATED : October 28, 1980

INVENTOR(S) : James P. Stirniman

It is certified that error appears in the above—identified patent and that said Letters Patent is hereby corrected as shown below:

engageable with a cam means adjacent a portion of the banding apparatus closed loop, said cam means causing predetermined translational movement of the movable guide roller to open and close access to the skein receiving pocket;

f) printing means for printing indicia on the bands to be wrapped;

g) band feed means for feeding printed bands from the printing means to the banding units when they are in said one substantial linear portion of the loop;

h) skein feed means for feeding the skeins to the banding apparatus; and i) synchronizing means for synchronizing feed and wrapping of the bands and the skeins such that each banding unit receives a skein followed by a printed band and then the banding unit pocket closes and wraps the band.

UNITED STATES PATENT AND TRADEMARK OFFICE

CERTIFICATE OF CORRECTION

PATENT NO. : 4,229,925

DATED : October 28, 1980

INVENTOR(S) : James P. Stirniman

It is certified that error appears in the above—identified patent and that said Letters Patent is hereby corrected as shown below:

Col. 11, line 14, "transversely" was misspelled.

Col. 12, line 2, "transversely" was misspelled.

Signed and Sealed this

*Fourth* Day of *May 1982*

[SEAL]

*Attest:*

GERALD J. MOSSINGHOFF

*Attesting Officer*

*Commissioner of Patents and Trademarks*